United States Patent [19]

Madison

[11] 3,949,855

[45] Apr. 13, 1976

[54] TYPEWRITER CARRIAGE JAM PRECLUDING AND ACTION JAM RELEASE MECHANISMS

[75] Inventor: Theodore N. Madison, Wethersfield, Conn.

[73] Assignee: Litton Business Systems, Inc., New York, N.Y.

[22] Filed: Jan. 6, 1975

[21] Appl. No.: 538,953

Related U.S. Application Data

[62] Division of Ser. No. 333,389, Feb. 16, 1973, Pat. No. 3,876,054.

[52] U.S. Cl. ..... 197/91; 197/65; 197/86; 197/176

[51] Int. Cl.[2] ..... B41J 19/62

[58] Field of Search ..... 197/16, 1 B, 65, 64, 82, 197/84, 86, 91, 92, 176, 96

[56] References Cited

UNITED STATES PATENTS

| | | | |
|---|---|---|---|
| 1,873,553 | 8/1932 | Crumrine | 197/91 |
| 2,728,437 | 12/1955 | Kupper | 197/91 |
| 3,217,850 | 11/1965 | Frechette et al. | 197/82 |
| 3,268,051 | 8/1966 | Krauss et al. | 197/65 |
| 3,432,019 | 3/1969 | Hare | 197/91 |
| 3,455,430 | 7/1969 | Schweizer | 197/91 |

*Primary Examiner*—Ralph T. Rader
*Attorney, Agent, or Firm*—Joseph R. Spalla; Arthur Gershman

[57] ABSTRACT

A typewriter is provided with carriage control mechanisms such that more than one carriage control function can be initiated at one time. The arrangement of carriage function controls permit a dominant carriage movement to prevail, and less dominant carriage movement function controls will either give way or, in case of tabulation, give way and await completion of the dominant function while yet remaining in active position to arrest tabulating movement. No interlocking of carriage functions is necessary. More particularly, if a dominant carriage return is initiated, carriage return movement of the carriage will cause a backspace pawl, controlled by initiation of a backspace function, either immediately before or after carriage return movement begins, to move out of engagement from the escapement rack. If either a carriage or a backspace function is in progress, i.e., the carriage is moving to effect a carriage return or backspace, a tabulation function can still be initiated. If however, a set tab stop on the carriage, during movement of the carriage in return or backspace direction, encounters the tabular stop blade placed and latched in readiness to arrest a set tab stop during tabulation movement, it will cause the tab blade to be rocked out of the way yet remain latched whereby, on completion of carriage return movement, tabulation movement will begin and the first set tab stop encountered will be arrested by the positioned tab blade to terminate tabulating movement. Also provided is a tab set blade which, if operated during any carriage movement as would jam the carriage, will give way on encounter with set tab stops. Other features of the invention reside in a novel carriage construction, power roll construction, and power roll jam release controls.

2 Claims, 11 Drawing Figures

Fig_7
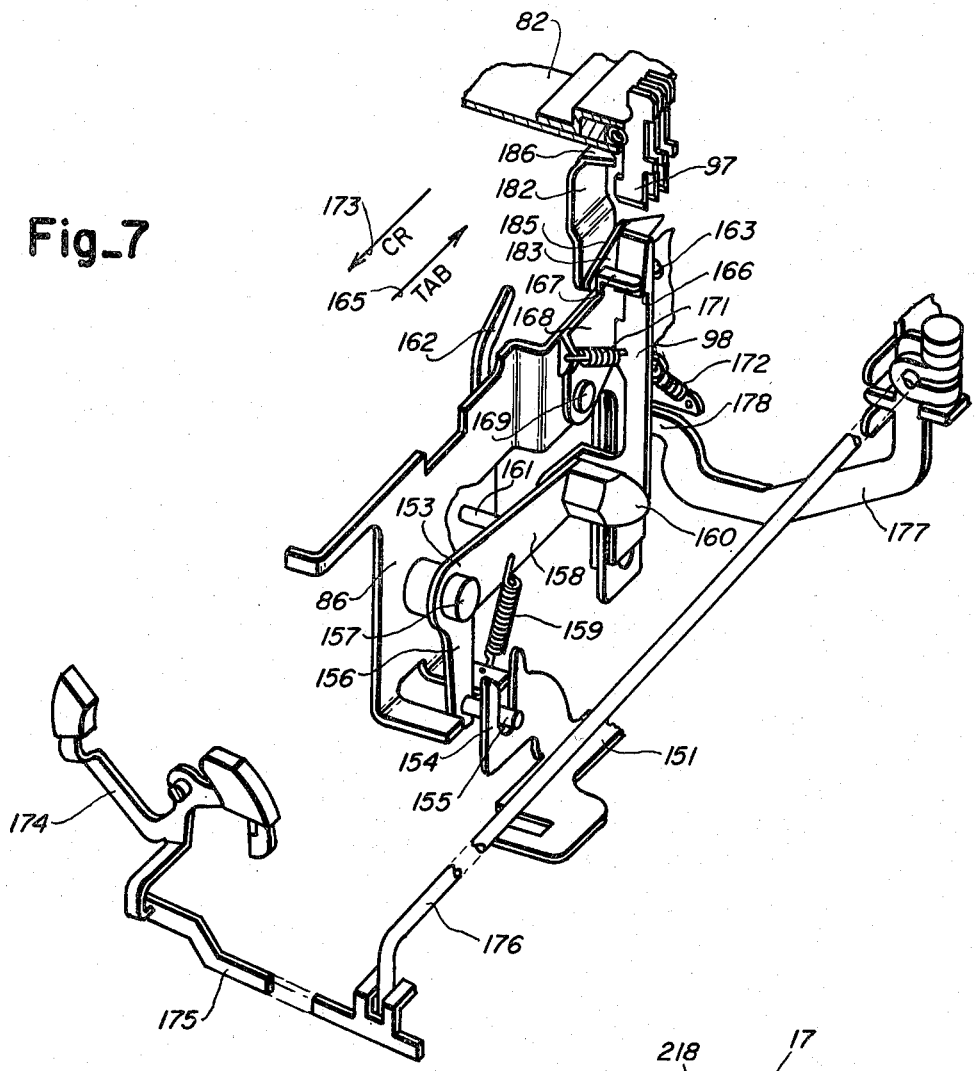
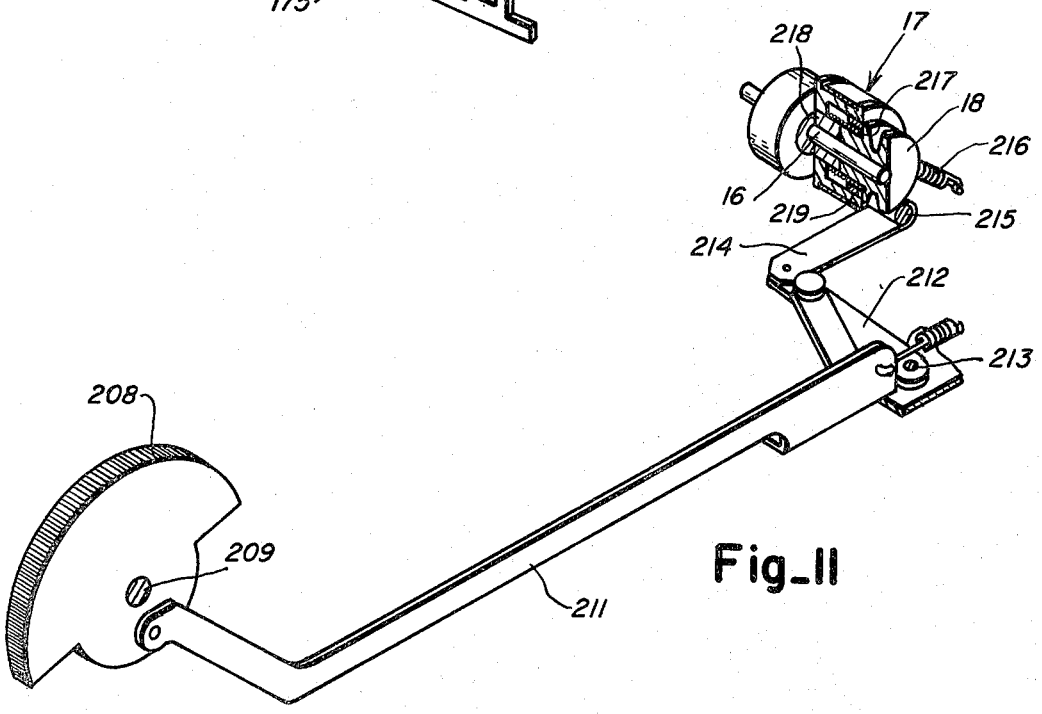
Fig_11

TYPEWRITER CARRIAGE JAM PRECLUDING AND ACTION JAM RELEASE MECHANISMS

This is a division of application Ser. No. 333,389, filed Feb. 16, 1973, now U.S. Pat No. 3,876,054.

BACKGROUND OF THE INVENTION

This invention relates to electrically powered typewriters and particularly jam precluding carriage function control mechanism. Typewriters having electrically powered carriage functions have usually provided interlock mechanisms which are operative to block initiation of a second carriage function while an earlier called function is in progress to avoid jams and damage to machine parts. Such interlock mechanisms add undue complexity to a machine and are expensive in terms of cost, assembly and adjustment.

SUMMARY OF THE INVENTION

This invention relates to jam precluding typewriter carriage tabulating, backspace, escapement, and carriage return mechanisms. More particularly, it relates to typewriter carriage control mechanisms having by-pass structures which give way after they have been actuated, to a more dominant or more highly powered carriage movement initiated contemporaneously; and, specifically, it relates to the interrelationship of these carriage function mechanisms wherein less dominant or lower power requirement functions give precedence to more dominant carriage movements.

Accordingly, an object of the invention is to provide jam free typewriter carriage control mechanisms wherein dominant carriage movements take precedence over other carriage movements.

Another object of the invention is in the provision of jam free typewriter carriage controls which are not interlocked and may be called contemporaneously with the dominant or strongest carriage movement prevailing.

Another object of the invention is in the provision of typewriter tabulation mechanism including a tab blade which after being actively positioned and latched can be displaced from active position or by-passed by a tab stop during either carriage return or backspace movement while yet remaining in latched active position for operation after termination of carriage return or backspace movement.

Another object of the invention is to provide a simple operator controlled power roll jam release structure.

Still another object of the invention is in the provision of a compact, light and balanced carriage to minimize twisting moments of the carriage incident to initiation and termination of carriage movements.

A further object of the invention is to provide for easily manufactured and assembled and easily removable power roll construction.

Still other objects, features and advantages of the present invention will become apparent to those skilled in the art from a reading of the following detailed description of a preferred embodiment, taken in conjunction with the accompanying drawing wherein like reference numerals designate like or corresponding parts throughout the several views and wherein.

IN THE DRAWING

FIG. 7 is a perspective view of tabulating stop blade and associated control structure;

FIG. 11 is a perspective view showing power roll jam release mechanism.

DESCRIPTION OF THE INVENTION

Figure 1:
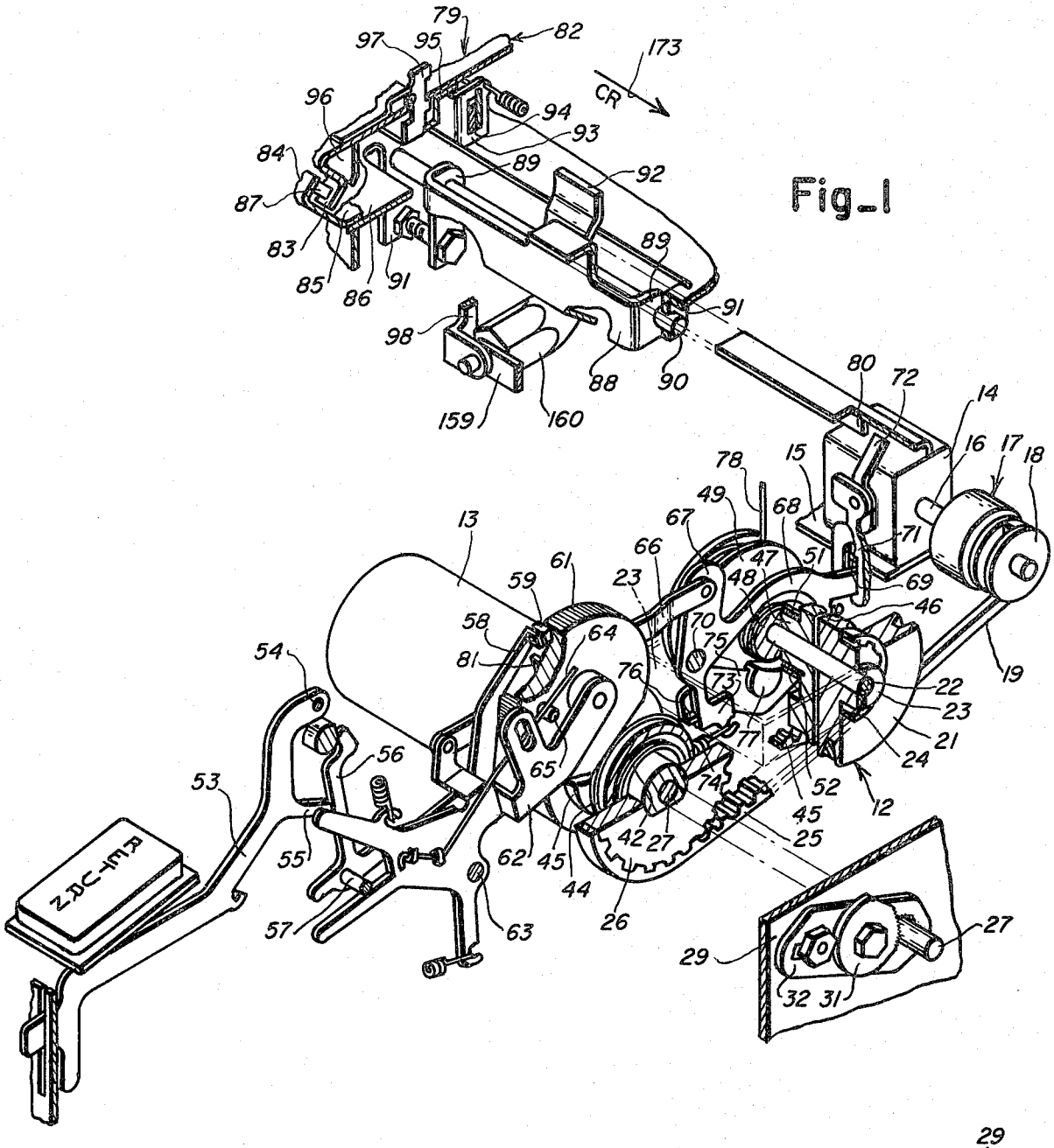
FIG. 1 is a perspective view of a power train and carriage return control mechanism with associated carriage and frame parts.

Referring now to the drawing wherein like reference numerals designate like or corresponding parts throughout the several views, there is shown in FIG. 1 a power train in the form of a speed reduction drive generally designated by reference numeral 12, which continuously drives a power roll 13 of a typewriter which upon engagement by cams of type actions drives the type actions and machine function mechanisms of the typewriter. The power train includes a motor 14 mounted on a base frame 15 whose output shaft 16 is connected through a normally engaged wrap spring reset clutch assembly generally designated by reference numeral 17 to a motor pulley 18.

The motor pulley 18 is connected by a V-belt 19 to a forward located intermediate pulley 21 rotatably mounted on a shaft 22 secured to a side frame supported bracket 23. Pulley 21 is integral with a smaller intermediate toothed pulley 24 on its outboard side which is connected by a toothed belt 25 to a toothed power roll drive pulley 26 rotatably mounted on a power roll support shaft 27 which is adjustably secured to the left and right side frames 28 and 29 by means of rotatably adjustable tooth eccentrics 31 secured to slotted adjusting plates 32, which are in turn secured to the machine side frames 28 and 29.

Known prior art power rolls are assembled as a unit including a center shaft which is supported for rotation in frame mounted bearings. After assembly of such a power roll the periphery is usually ground to make it concentric with the center shaft.

In accordance with this invention, power roll bearings are assembled with the power roll and the power roll periphery can be ground concentric with the bearings insuring greater accuracy. Another feature of the invention is the easy assembly, mounting, and disassembly of the shaft 27 which supports the power roll. The shaft 27 is adjustably fixed to the frame as noted but when loosened can be pushed through the power roll bearings to facilitate removal of the power roll.

Figure 2:
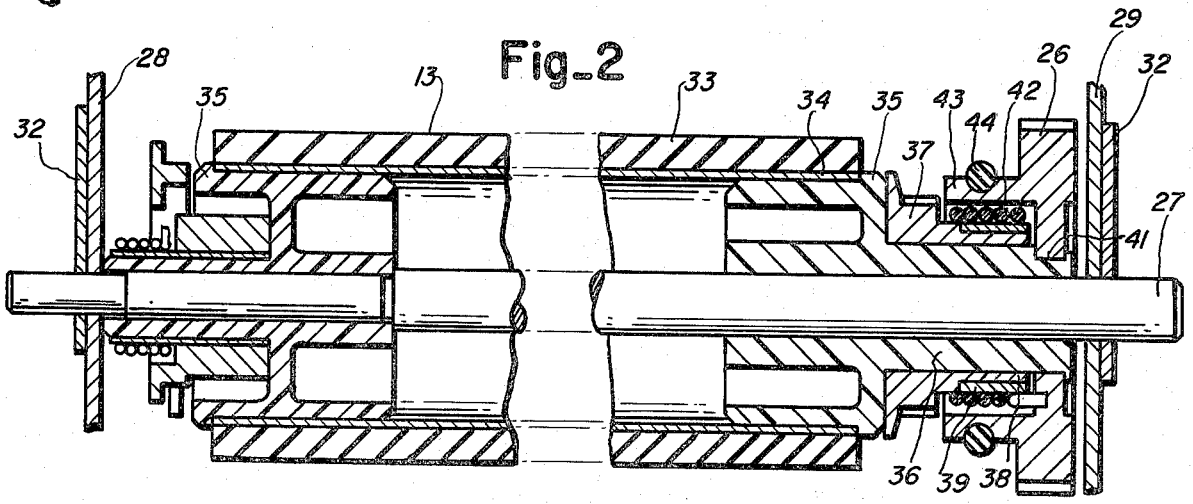
FIG. 2 is a sectional view showing the power roll construction.

With reference to FIG. 2, the power roll 13 comprises an outer rubber cover sleeve 33 supported on an inner core sleeve 34. Plastic bearings 35 which are supported on the shaft 27 which extends therethrough, are press fitted into the ends of the core sleeve 34. The bearing 35 in the right end as viewed in FIG. 2 has an outwardly extending hub 36 which rotatably supports a toothed carriage return drive pulley 37 which itself has a rightward extending hub 38 around which is secured a metal sleeve 39. The power roll pulley 26 is keyed as at 41 to the end of the bearing hub 36 thereby to drive the bearing 35 and the power roll 13. A torque limiter spring 42 is tightly wrapped about the metal sleeve 39 and has one end secured to the power roll pulley 26 whereby the carriage return pulley is normally frictionally driven. On initiation of a carriage return, the spring 42 will slip whereby the load of the carriage is assumed smoothly. The power roll pulley 26 is further provided with a hub 43 extending inwardly over the torque limiter spring which supports an O-ring 44 which serves to drive a carriage return roll cam.

With reference again to FIG. 1, the carriage return drive pulley 37 is connected by a toothed belt 45 to a larger second carriage return drive pulley 46 rotatably mounted on shaft 22 inward of the intermediate drive pulley 21. The carriage return drive pulley 46 is provided with an inward extending hub 47 coaxial with an outward extending hub 48 of a carriage return drawband pulley 49. Wrapped about both hubs 47 and 48 is a normally open clutch wrap spring 51 having one end 52 connected to the carriage return drive pulley 46. The spring constitutes a carriage return clutch.

As viewed in FIG. 1, a carriage return keylever 53 is pivotally supported on a bracket supported transverse fulcrum rod 54, which also pivotally supports the other keylevers of the typewriter keyboard. Depression of the carriage return keylever 53 causes a finger 55 thereon to push against and rock clockwise a trip lever 56 pivotally supported, as are all other action trip levers, on another bracket supported transverse fulcrum rod 57. A bent off end 58 of a rearward extension of the trip lever 56 is normally positioned in the path of a primary stop 59 on a carriage return roll cam 61, which is mounted on a sublever 62 that is also pivotally supported, as are all other action sublevers, on another bracket supported fulcrum rod 63. Depression of the carriage return keylever 53 rocks the trip lever 56 clockwise as viewed in FIG. 1 with the result that its end 58 moves away from and releases the primary stop 59 to thereby allow a rod spring 64 on the sublever to act against an abutment 65 on the side of the cam opposite primary stop to rock the cam 61 into engagement with the O-ring 44. The eccentrically mounted cam 61, as it is driven, rocks the sublever 62 counterclockwise pulling a link 66 forwardly. The rear end of the link 66 is connected to a crank 67, which is pivoted on a shaft 70 secured to the machine side frame supported bracket 23. The crank 67 has a first rearwardly extending arm 68 which extends above and beyond the clutch spring 51 into a vertically extending slot 69 of a bracket 71. The bracket 71 pivotally supports a carriage return clutch latch 72 biased in a counter-clockwise direction toward the slot 69. A second depending arm 73 of the crank has a spring 74 connected thereto and to a frame anchor (not shown). Another lever 75 pivoted on shaft 70 has an offset tail 76 abutting the rear of arm 73. Lever 75 extends rearwardly and its rear end is connected by a spring (not shown) which is anchored on the frame to thereby bias lever 75 counterclockwise. Lever 75 also has a friction shoe 77 attached thereto positioned below the carriage return clutch spring 51. Thus, as crank 67 is rocked, the end of arm 68 moves upwardly and is latched by the carriage return latch 72. Simultaneously, because arm 73 moves, lever 75 normally blocked thereby is spring urged upward and the friction shoe 77 is allowed to engage the wrap spring 51 causing it to wrap and couple the carriage return pulley 46 to the drawband pulley 49, which winds the carriage return drawband 78 and moves the carriage, generally designated by reference numerals 79, to which it is connected, to the right as viewed in FIG. 1 until an abutment 80 on the carriage hits the latch 72 releasing the crank arm 68 for return to normal position which retracts lever 75 thereby releasing the clutch spring 51. As the carriage return cam 61 rotates, it brings a secondary stop 81 around into contact with the end 58 of the rocked trip lever arresting the cam 61 if the carriage return key is still depressed. On release of the carriage return key 53 the end 58 of the trip lever will be moved up to again engage the primary stop 59 on the cam.

The carriage 79 as viewed in FIG. 1 has a transverse carriage beam generally designated 82 whose edges form rails 83 shaped complementary to rails 84 of a transverse carriage supporting beam 85 supported on a machine frame supported compound bracket 86 between which rails are roller elements 87. Mounted on the bracket 86 is a center stop structure 88. More particulary, the center stop structure 88 has rearwardly extending arms 89 secured to a bracket supported shaft 90. The lower rail defining machine frame supported bracket 86 also has downwardly exending arms 91, which pivotally support the shaft 90 outwardly of the center stop structure support arms 89 yet allow movement of the center stop structure a limited distance to the left from the normal position shown which movement is used to provide line locking as more particularly shown in an application of Theodore N. Madison Ser. No. 333,295 filed of even date with this application titled Type Action Arrangement now U.S. Pat. No. 3,838,762. A center stop 92 normally extends upwardly and lies in the path of margin stops 93 settable along a margin rack 94.

A salient feature of the invention resides in that the carriage beam 82 supports on its underside the margin rack 94, the tab rack 95, and the escapement rack 96. This arrangement reduces the moment arms tending to rotate the carriage about a vertical axis whenever the carriage 79 is arrested as when a margin stop 93 encounters the center stop 92 or a set tab stop 97 encounters a positioned set tab blade 98 (FIG. 7) or when an escapement pawl 101 (FIG. 3) or a backspace pawl 102 (FIG. 9) engages the escapement rack 96. This balanced construction reduces tendency to bind and jam and permits the carriage frame to be made from light sheet metal lessening its weight. The low mass balanced carriage construction permits the elimination of carriage arresting dash pots yet allows the carriage to be fully returned to the left margin and placed again under control of the escapement with even margin assured.

Figure 3:
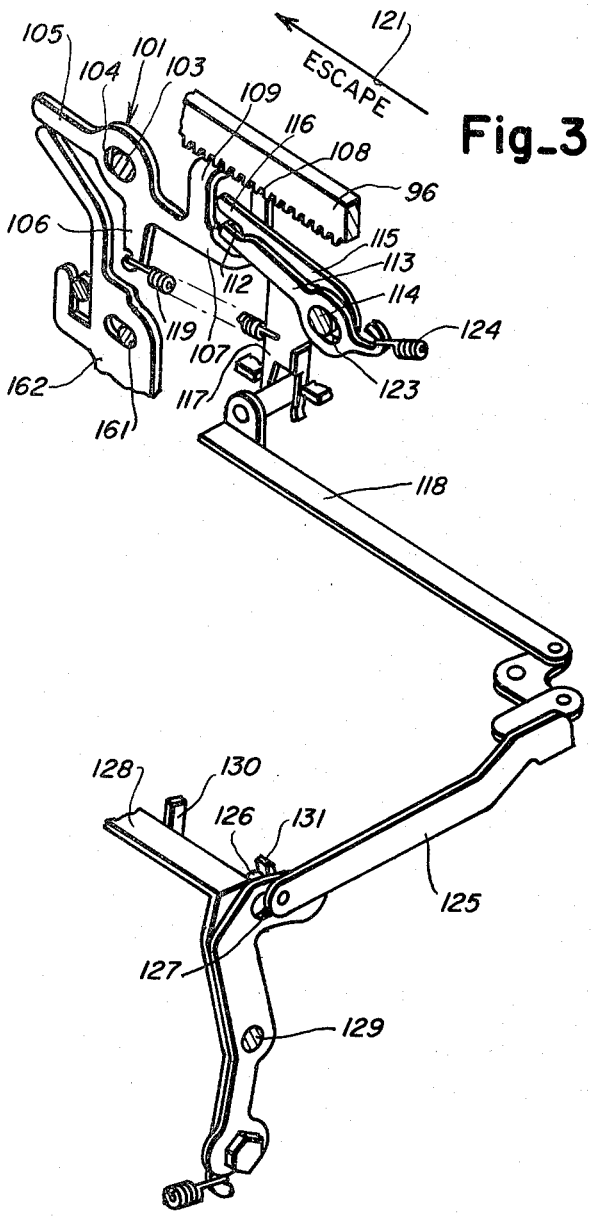
FIG. 3 is a perspective view of an escapement mechanism.
Figure 4:
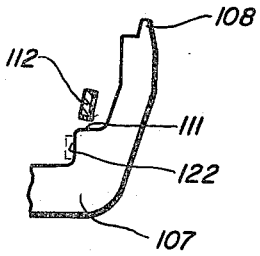
FIG. 4 is a partially schematic view showing the escapement pawl and associated by-pass slide in normal and by-passed relationships.

Cooperating with the escapement rack 96, as shown with reference to FIG. 3, is an escapement mechanism comprising the single pawl 101 pivoted on a stud 103 which extends from the machine frame bracket 86 and into a slot 104 in the pawl 101 of a length allowing an escapement. A tab release arm 105 of the pawl extends leftwardly of the pivot and a pawl return arm 106 extends downward below the pivot stud 103. An arm 107 extending rightward of the pivot stud is bent rearwardly and upwardly and terminates in a rack engaging tooth 108. The arm 107 also is formed with an upwardly and rearward extension 109, which cooperates with a carriage release bail (not shown) to disengage the escapement pawl from the rack 96 as in conventional machines. As viewed in FIG. 4, the upwardly extending toothed arm 107 is provided with a step 111, which is normally in the path of a rearwardly bent end 112 of an escapement by-pass slide 113, which is pivoted on a stud 114 of the machine frame bracket 86. Also mounted on the stud 114 outwardly of the by-pass slide 113 is an escapement trip lever 115 having a leftward extension, the end 116 of which is forked and embraces the bent end 112 of the by-pass slide 113. A downward extending arm 117 of the escapement trip lever 115 is also forked to receive a link 118 operative to the right to rock the trip lever counter-clockwise causing the left forked end 116 to rock the by-pass slide 113, which in turn acts on the step 111 to retract the pawl from the escapement rack 96. A spring 119 is connected between arm 106 of the pawl and the arm 117 of the trip lever which serves to normally bias the pawl into rack engagement and move it relative to the escapement rack 96 a pitch distance permitted by the pawl slot 104 and to reengage the escapement rack. Escapement movement of the carriage in the direction of arrow 121 occurs under control of a conventional spring motor (not shown), as is conventional, and carries with it the released and reengaged pawl to the other limit of the slot 104 to effect an escapement. During this carriage movement, should the trip lever 115 remain in rocked condition, the bent over end 112 of the by-pass slide 113 will be in the path of and will be moved by the vertical portion 122 of the step 111 on the pawl 101 as permitted by a slot 123 on the by-pass slide until the trip lever is restored to normal, at which occurrence a spring 124 connected to the by-pass slide 113 brings it back to a position above step 111. This provides escapement by-pass.

The escapement link 118 is connected via a crank to a link 125 coupled by a pin 126 extending into a slot 127 of a U-bar 128 which is powered in forward direction about pivots 129 in response to movement of a type action sublever 130 or in response to the movement of the sublever 131 of a powered escapement action initiated by space bar operation acting against the pin 126.

Figure 5:
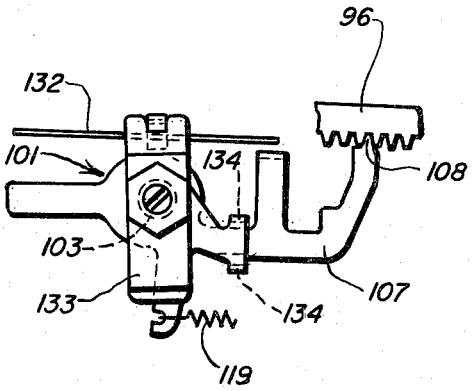
FIG. 5 is an elevational view showing escapement control mechanism to provide silent carriage return movement.

As viewed in FIG. 5, a wire 132 extending from end to end of the carriage 79 is frictionally gripped by a lever 133 pivoted on the stud 103 which is rocked during carriage return movement. Fingers 134 thereon embracing the escapement pawl arm 107 act to disengage the escapement pawl 101 from the rack 96 to provide noisefree carriage return movement.

Figure 6:
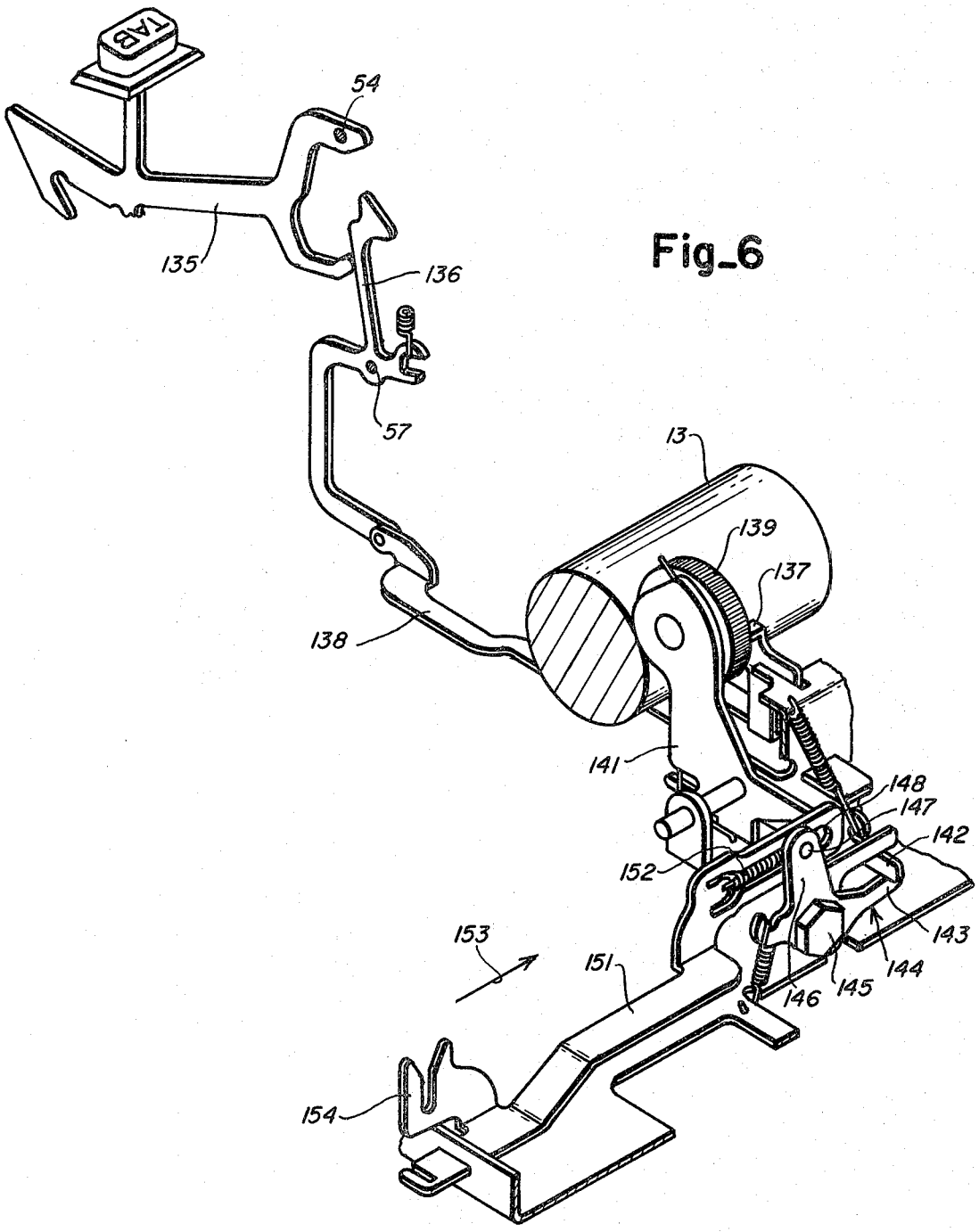
FIG. 6 is a perspective view of powered tabulating control mechanism.

With reference to FIG. 6, a tabular key lever 135 is pivoted on fulcrum rod 54 and moves a trip lever 136 secured on fulcrum rod 57. The end 137 of a link 138 connected to the trip lever releases the primary stop of a cam 139 mounted on a sublever 141 allowing the cam 139 to engage and be rotated by the power roll 13 and rock the sublever 141 clockwise. A rearward tail 142 of the sublever 141 overlies a horizontally disposed crank arm 143 of a lever 144 pivoted as at 145 on the base frame bracket. The lever 144 has an upward extending arm 146 from which a pin 147 projects forwardly and through a slot 148 in a tab link 151. A spring 152 connects between the pin 147 and the tabular link 151. The action of lever 144 pulls the link 151 in the direction of arrow 153.

As viewed in FIG. 7, the end 154 of the link 151 is forked and embraces a pin 155 extending from the depending arm 156 of the tab blade positioning lever 153 pivoted as at 157 on bracket 86. The arm 158 of the lever extending to the right as viewed in FIG. 7 is connected by a tab blade return spring 159 to the bracket 86 and its end has a center stop control projection 160, which serves to move the center stop 92 out of the path of margin stops 93 during tabulation. The lever arm 158 also has a pin 161 extending therefrom which serves to raise a lever 162 (FIG. 3) mounted on bracket 86 against the arm 105 of the escapement pawl to release the escapement pawl during tabulation. The tabular blade 98 is pivoted on the end of lever arm 158 and extends upwardly, its terminal end serving in combination with a tab abutment 163 on the bracket 86 to engage a set tab stop 97 and arrest tabulating carriage movement indicated to be in the direction of arrow 165. The tab stop blade near its terminal end is provided with an overhanging edge 166 which, when the blade is raised, latches over a finger 167 extending from a latch plate 168. The latch plate 168 is pivoted on a stud 169 extending from bracket 86 and is connected by a spring 171 to the tab blade 98, which serves to maintain tab blade 98 spaced from abutment 163. The latch plate 168 is also connected by a return spring 172 to the bracket 86, and its clockwise movement is limited by an abutment (not shown) on the bracket 86. A tabulating movement of the carriage in the direction of arrow 165 will bring a set tab stop 97 against the positioned and latched tab blade 98, rocking tab blade 98 clockwise about its pivot on lever 158 against the stop abutment 163 and releasing it from the latch finger 167 to allow spring 159 to return the tab blade 98 downward. Should a carriage return or backspace motion in the direction of arrow 173 be initiated while the tab stop blade 98 is positioned and latched, and a set tab stop 97 comes along, the tab blade 98 will be rocked counter-clockwise and carry the latch plate 168 counterclockwise about its pivot 169 to allow the carriage to continue movement yet retaining the latched relationship. Thus, at the termination of backspace or carriage return motion, tabulating movement will automatically occur and the first set tab stop 97 that comes along will encounter the tab blade 98 moving it against abutment 163 to arrest the carriage 79, unlatching it for return to normal position.

Figure 8:
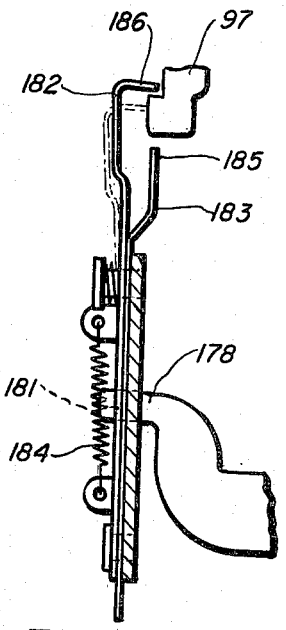
FIG. 8 is an elevational view showing details of the tab set and clear control structure.

With reference again to FIG. 7, a tab set and clear lever 174 is provided having a common arm 175 linked to rock a bail 176. The bail 176 is secured to a lever 177 whose end 178 extends into slots 181 in a tab clear slide 182 and a tab set slide 183. As viewed in FIG. 8, the set and clear slides 182 and 183 are connected by a spring 184 to return the one or the other to inactive position when the other is moved to action position. The upper end 185 of the tab clear slide 183 is triangularly shaped to cam set tab stops 97 to reset position should the tab clear key be depressed during any carriage movement. Similarly, the tab stop set slide 182 has a triangular end stop 186. Should the tab set slide 182 be activated while any carriage movement is in progress, then the tab set slide 182 will be cammed transversely as illustrated out of the way by any set tab stop 97, and avoid a jam.

Figure 9:
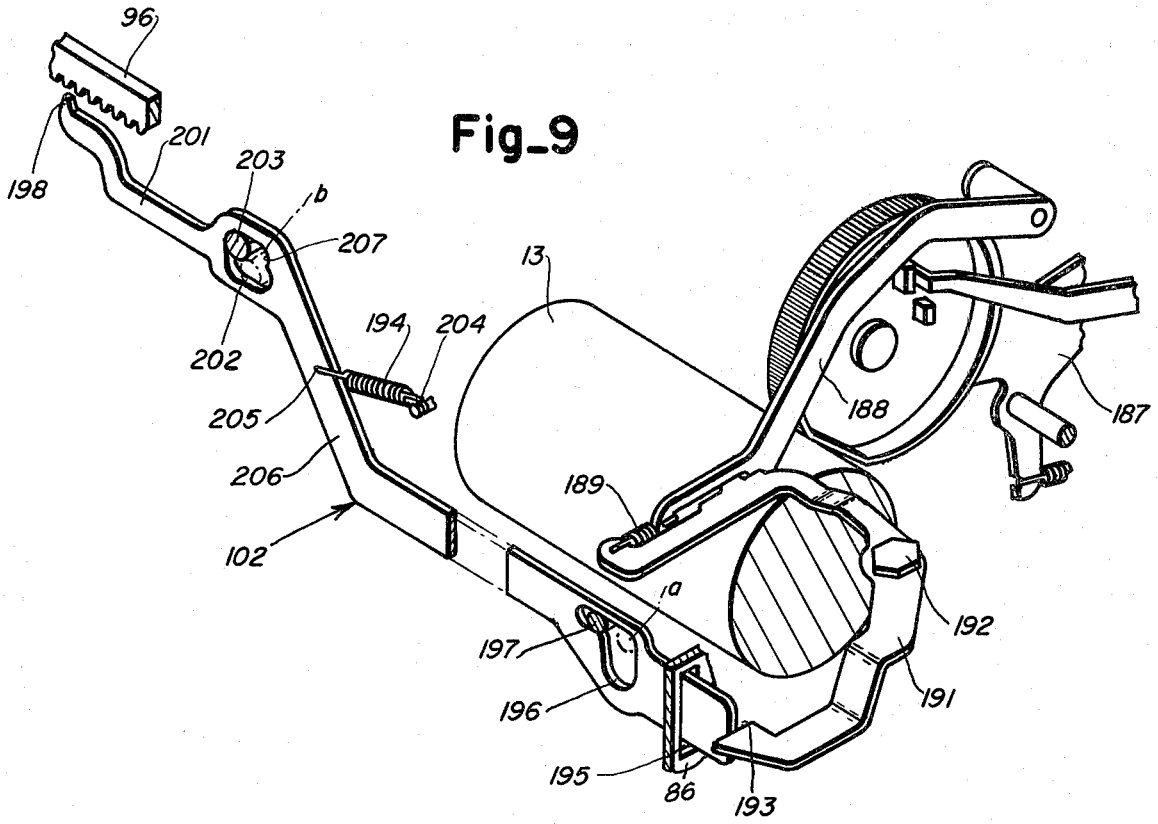
FIG. 9 is a perspective view showing backspace mechanism.
Figure 10:
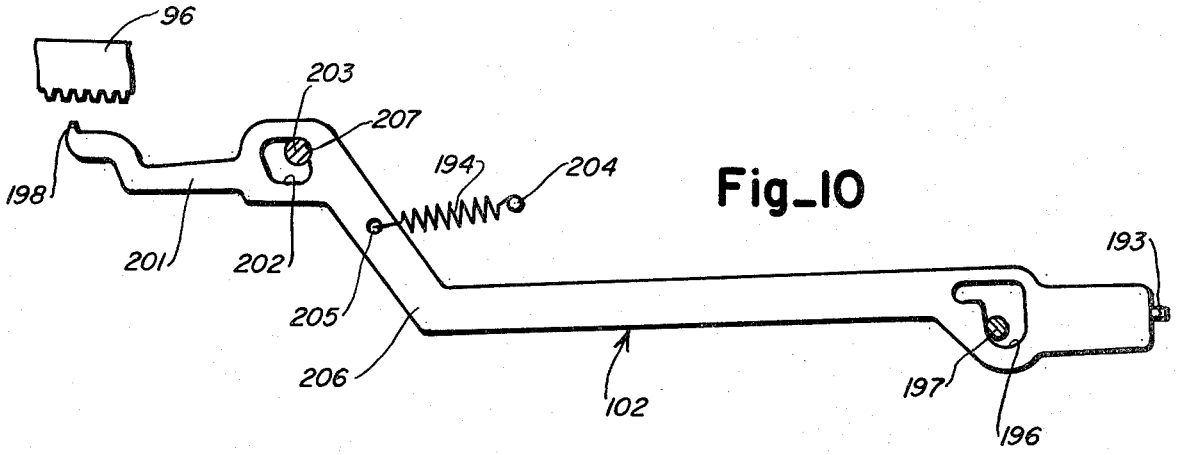
FIG. 10 is an elevational view illustrating backspace operation and by-pass relationships.

A backspace mechanism is shown in FIG. 9. As with carriage return, a backspace keylever depression will trip a backspace action and the rocking movement of the backspace cam sublever 187 will pull an intermediate link 188. The link 188 is connected by a motion transmitting spring 189 to a bell crank 191 mounted on a vertical pivot as at 192 whose end 193 is held in contact with the single piece backspace pawl 102 by a pawl return spring 194. The backspace pawl 102 is guided in a slot 195 in a frame bracket 86 and is provided with an inverted "L"-shaped opening 196 adjacent the crank end 193. A pin 197 projecting from bracket 86 extends into the horizontal portion of the opening 196 and serves as a pivot for the backspace pawl 102. The pawl extends to the left as viewed in FIGS. 9 and 10, and is bent upward and then horizontally with the terminal portion bent upwardly and formed as a tooth 198. The last horizontal run 201 of the pawl has a generally trapezoidal opening 202 into which a pin 203 extends. The normal position of the pawl is as viewed in FIG. 9 with the pin 203 in the uppermost left corner of opening 202 and the pin 197 in the farthest part of the horizontal slot of the opening 196. The fixed spring anchor 204 is above the point of connection 205 to the upward run 206 of the pawl and the geometry causes the backspace pawl, when moved by the crank 191, to move initially upward into rack engagement about pin 197, and then horizontally. The pins 197 and 203 supporting the pawl, incident to these pawl movements, assume the relative positions designated *a* and *b* in FIG. 9. Should a carriage return movement be in progress or be initiated, the backspace pawl would be cammed out of and by the escapement rack with the vertical leg of the opening 196 permitting disengagement movement of the pawl as shown in FIG. 10 until restoration of the pawl is permitted by return movement of the crank 191. Throughout carriage return movements or until crank 191 is released, the pawl will be held in disabled active condition shown by means constituting pin 203 and the upper corner notch 207 of the opening 202.

With reference to FIG. 11, a jam reset mechanism is provided to overcome jams causing the motor 14 to stall. Such jams may occur when a number of function keys, such as carriage return, shift, backspace, space bar and tab, are inadvertently depressed when the electrical power supplied to the motor is reduced or when the typewriter is disconnected from a source of electric power. Accordingly, when power is again supplied to the typewriter, the simultaneous engagement of the various typewriter mechanisms may prevent the motor 14 from operating resulting in a jammed condition. As viewed in FIG. 11, a jam release wheel 208 is rotatably mounted on the machine side frame as at 209 and controls a link 211 eccentrically connected to the wheel 208 at one end and at the other end to and between the ends of a lever 212. The lever 212 is pivoted about a vertical bracket-supported pivot 213 at one end and to a friction belt 214 at its other end. The friction belt is trained around a shaft 215 to the rear of and below the reset clutch assembly 17 between motor and drive pulley 18, and around the reset clutch assembly with its other end connected to a spring 216 anchored on the machine frame. The clutch, as before noted, comprises a wrap spring 217 which is tight around a hub 218 secured to the motor shaft 16 and has one end secured to the pulley 18 which has an outer sleeve 219 surrounding the wrap spring 217. Tightening the friction belt 214 serves to frictionally rotate sleeve 219 and thus to unwrap the clutch spring 217 sufficiently to break the motor pulley connection as will allow the motor to come up to speed. Release of the wheel 208 will again allow the clutch spring to wrap and couple the motor shaft 16 to pulley 18 and deliver to the power roll an impact as will aid to release a jam condition.

Reviewing a dominant carriage return has precedence over all other functions. A carriage return movement always releases the escapement dog, it effects disengagement of the backspace pawl if operated during carriage return movement, it momentarily disables the tabulating and tab set mechanism if initiated contemporaneously with carriage return. Backspace motion, the next in order of dominance also takes precedence over tabulating and tab set function and tabulating takes precedence over tab set.

The invention claimed is:

1. In an electric typewriter having a frame and a carriage movable relative to said frame in carriage return, backspace, escapement and tabulating directions, an escapement rack mounted in said carriage controlled by an escapement pawl, a backspace actuator pivotally mounted on said frame, a backspace pawl mounted on said frame for pivotal movement in a forward direction about a first pivot extending through a first opening in said pawl from a rest position to engagement with said escapement rack and for limited lateral movement to drive said rack one tooth in response to actuator movement thereagainst, a spring connected between said pawl and frame for holding said pawl in rest position in contact with said backspace actuator, means on said pawl and frame including a second pivot extending through a second opening in said pawl for allowing reverse pivoting of said pawl about said second pivot to a disabled active position in response to carriage return movement initiated contemporaneously with backspace movement, and means for holding said pawl in said disabled active position until termination of carriage return movement or retraction of said backspace actuator.

2. In an electric typewriter having a frame and a carriage movable relative to said frame in carriage return, backspace, escapement and tabulating directions, an escapement rack mounted on said carriage, a backspace pawl actuator, a backspace pawl having one end positioned to be driven by said actuator, said pawl having a first horizontal run extending from said one end, an upward direction run, and a second horizontal run terminating in an upwardly directed rack engaging tooth, a first opening adjacent said one end having a vertical portion and a horizontal portion directed toward said toothed end, a second trapezoidal opening in said second horizontal run, first and second frame mounted pins extending into said first and second openings, and a spring connected at one end to said upward run and to said frame at a point vertically spaced from the point of connection to said upward run, thereby holding said one end of the pawl against said pawl actuator with said first pin located at the end of said horizontal portion and said second pin in the upper corner of said trapezoidal opening closest to said toothed end, and means for driving said pawl actuator whereby said pawl is pivoted upwardly about said first pin to engage the rack and is moved relative to said pins to the extent permitted by said horizontal portion of said first opening, said pawl being drivable out of engagement from the rack to a by-pass position by a carriage return movement initiated contemporaneously with actuation of said backspace pawl, said movement being accommodated by the vertical portion of said first opening, and means in said second opening for holding said pawl in by-pass position during carriage return or until said backspace actuator allows return of said pawl.

* * * * *